United States Patent [19]

Leuthold et al.

[11] 4,247,215

[45] Jan. 27, 1981

[54] MECHANICAL PENCIL

[75] Inventors: Werner Leuthold, Schwabach; Svatopluk Krumnikl; Günther Babel, both of Nuremberg, all of Fed. Rep. of Germany

[73] Assignee: A. W. Faber-Castell, Nuremberg, Fed. Rep. of Germany

[21] Appl. No.: 910,504

[22] Filed: May 30, 1978

[30] Foreign Application Priority Data

May 28, 1977 [DE] Fed. Rep. of Germany ..... 2724317

[51] Int. Cl.[3] ..... B43K 21/16

[52] U.S. Cl. ..... 401/85; 401/134

[58] Field of Search ..... 401/55, 56, 57, 65, 401/67, 85, 82–84, 73, 132–134

[56] References Cited

U.S. PATENT DOCUMENTS

| | | | |
|---|---|---|---|
| 1,866,072 | 7/1932 | Woelm | 401/85 X |
| 2,049,208 | 7/1936 | Leistenschneider | 401/85 X |
| 2,053,892 | 9/1936 | Beck | 401/133 |
| 2,130,230 | 9/1938 | Cohen | 401/85 X |
| 2,222,824 | 11/1940 | Rossier | 401/85 X |
| 2,243,109 | 5/1941 | Lynn | 401/85 X |
| 2,311,906 | 2/1943 | Leistenschneider | 401/85 X |
| 2,525,229 | 10/1950 | Lynn | 401/85 X |
| 2,802,448 | 8/1957 | Young | 401/134 |
| 3,072,101 | 1/1963 | Kovacs | 401/85 X |
| 3,813,175 | 5/1974 | Katz | 401/67 X |

*Primary Examiner*—Edward M. Coven

*Attorney, Agent, or Firm*—Michael J. Striker

[57] ABSTRACT

A mechanical pencil of the type having a pushbutton lead-feeding mechanism is provided with a space into which a replaceable cartridge containing leads can be inserted. The cartridge has a lead outlet opening which is blocked by a closure that is moved out of the way upon such insertion so that the leads can thereupon move sequentially into the lead-feeding mechanism, permitting a user to write until all leads in the cartridge are used up.

1 Claim, 9 Drawing Figures

FIG. 1
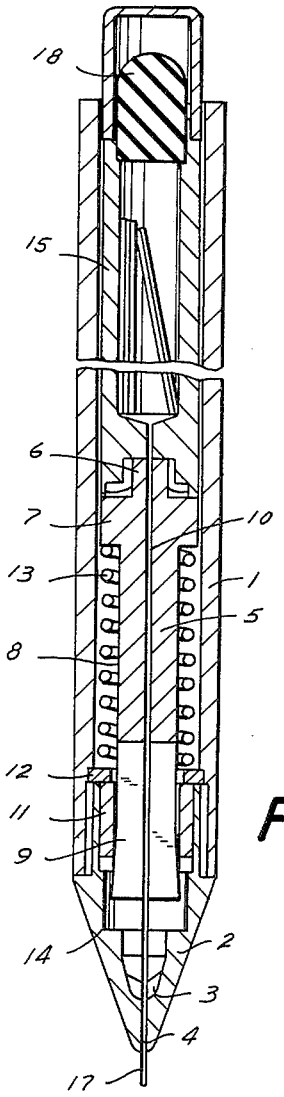
FIG. 2
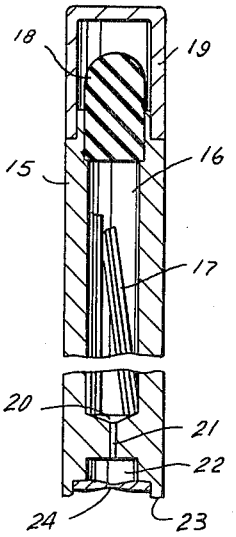
FIG. 3
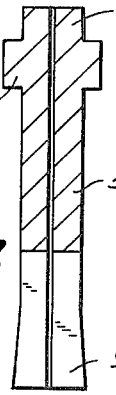
FIG. 4
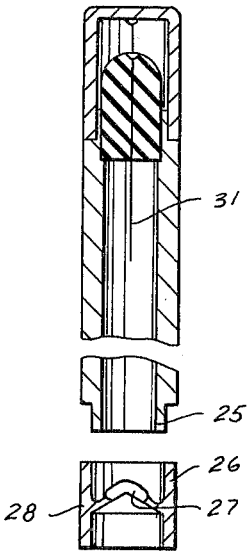
FIG. 5
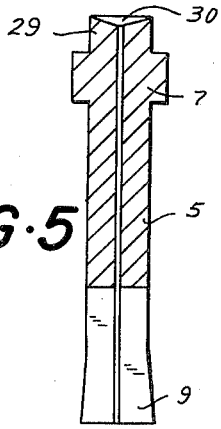
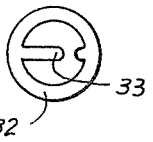
FIG. 6
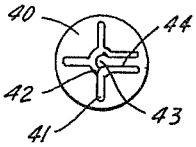
FIG. 7

MECHANICAL PENCIL

BACKGROUND OF THE INVENTION

This invention relates in general to mechanical pencils.

More particularly, the invention relates to a mechanical pencil having an improved lead-propelling mechanism.

There are two basic types of mechanical pencils, namely, the type in which the lead is propelled by turning some part of the pencil (e.g., of the barrel) and the type in which the propulsion is effected by pushing a button or similar element. The present invention is concerned in particular with this second type.

In pencils of this second type the lead is fed incrementally and, if the pencil is provided with a lead reservoir for storing a supply of leads, care must be taken that as each lead is being used up another lead is reliably fed to the propelling mechanism, such feeding of consecutive leads to continue until all leads in the reservoir have been used up. To assure this it is absolutely necessary for the reservoir and the channel connecting the same with the propelling mechanism, to be so constructed that the advancement of the consecutive leads can proceed without interference or hindrance.

German Patent No. 1,815,535 discloses a mechanical pencil in which the lead reservoir conically converges in direction towards the tip of the pencil, to guide the leads to the propelling mechanism. The leads, which are conventionally sold in a tubular or otherwise shaped container (see, for example, German Utility Model No. DGBM7723734), are removed from the container and inserted into the reservoir. This is, however, undesirable because it requires the user to handle the thin and very fragile leads. Also, the number of leads in the container is usually greater than the number of leads which can be accommodated in the reservoir so that the user, to avoid overfilling and malfunctioning, must count out the requisite number of leads which again leads to undesirable handling problems.

SUMMARY OF THE INVENTION

It is an object of the invention to overcome the disadvantages of the prior art.

More particularly, it is an object of the invention to provide an improved mechanical pencil in which the user does not need to handle the leads at all when refilling the pencil.

In keeping with these objects, and with others which will become apparent hereafter, one feature of the invention resides, in a mechanical pencil, in a combination comprising a housing having a front end provided with a tip, and a rear end portion; lead feeding means reciprocable in the housing for incrementally advancing leads from the rear end portion to and outwardly beyond the tip; and coupling means on the lead feeding means and operative for coupling with a lead-containing cartridge which is removably insertable into the rear end portion, so as to establish a lead supplying passage between the cartridge and the lead feeding means through which passage leads from the cartridge can sequentially pass to the lead feeding means.

The invention thus proposes a mechanical pencil having a lead reservoir which is refilled with a supply of leads accommodated in a cartridge. When the cartridge is inserted into the reservoir an outlet opening of the previously sealed cartridge is automatically opened (this must take place without requiring the application of substantial force) so that the leads can sequentially be fed to the tip of the pencil. Guidance of each lead during its incremental travel to the pencil tip must be very exact, to avoid lead breakage. This requires that the inserted lead cartridge be precisely centered with reference to the propelling mechanism; on the other hand, however, the cartridge must also be easily insertable and removable from the reservoir.

Furthermore, the pencil according to the invention is to have the conventional lead-feeding pushbutton beneath which an eraser and a cleaning needle are to be accommodated in the usual manner. The closure for the cartridge, i.e., the closure which is automatically removed on insertion of the cartridge, must be such that upon its removal it does not interfere with feeding of the leads, and that it can not remain behind in the reservoir or in the lead channel when the cartridge is removed to be replaced with a new one. The connection between the cartridge and the pencil must be sufficiently firm to avoid unintended separation, yet not so firm as to prevent easy intended separation.

Mechanical pencils of the type under discussion are mass-production items. For this reason the invention must not increase the manufacturing expense of the pencil and the lead cartridge must be capable of being manufactured inexpensively and in a simple manner. In fact, the manufacturing costs of the cartridge should be comparable to those of a conventional lead container of the type used heretofore. Since assembly costs constitute a substantial part of the overall manufacturing cost, the parts are to be capable of being assembled by automated equipment; a prerequisite for this is that the individual parts must be so configurated that they need not assume a specific orientation relative to one another during assembling.

To meet these requirements the lead cartridge has an outlet opening which is closed by a closure in form of a thin, flat disk, and the inner end of the lead propelling mechanism of the pencil is provided with a coupling projection onto which the lead cartridge can be pushed in such a manner that, when the closure is removed, a continuous channel is established between the cartridge outlet opening and the lead reservoir.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a longitudinal section through a mechanical pencil according to the invention, showing a lead cartridge in installed position;

FIG. 2 is a longitudinal section through the lead cartridge, in sealed condition;

FIG. 3 is a sectional detail view, showing a part of the lead propelling mechanism;

FIG. 4 is a longitudinal section through a lead cartridge according to another embodiment;

FIG. 5 is a view similar to that in FIG. 3 but illustrating a modified embodiment;

FIG. 6 is a plan view of a different embodiment of a closure for the lead cartridge;

FIG. 7 is a view similar to FIG. 6 but of another embodiment of the closure;

DESCRIPTION OF THE PREFERRED EMBODIMENTS

Figure 8A:
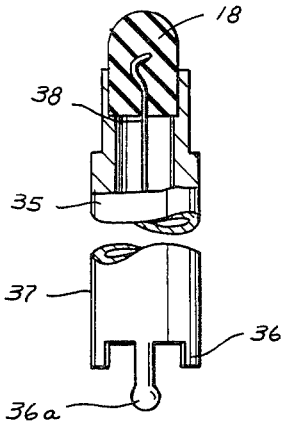
FIG. 8*a* is a fragmentary section, showing an embodiment of a lead cartridge in a first manufacturing stage.

FIGS. 1–3 illustrate a mechanical pencil with a pushbutton lead propelling mechanism having, in the conventional manner, a housing 1 into which a front portion 2 is threaded which contains a lead brake 3 and is provided with a lead outlet opening 4. The propelling mechanism 5 carries at the upper end a coupling portion 6 and an annular collar 7; at the end facing towards the pencil tip a clamping neck 8 merges into a diverging clamping head 9. A lead guiding channel 10 extends through the entire propelling mechanism.

A clamping ring 11 surrounds the head 9 and abuts one axial face of a support ring 12 which is held stationary between the elements 1 and 2. A helical expansion spring 13 bears with its opposite ends upon the other axial face of the ring 12 and upon the annular collar 7, respectively. A step 14 is formed in the element 2 to limit the forward movement of the head 9.

A lead cartridge 15 is pushed onto the coupling portion 6 and its interior 16 constitutes a reservoir which contains the leads 17. The rear end of the cartridge 15 is closed by an eraser 18 which becomes accessible when the cap 19—which serves as a pushbutton to actuate the propelling mechanism—is pulled off. The lower end of the interior 16, i.e., the one which is installed condition faces towards the tip of the pencil, is shaped as a funnel 20 which leads into the outlet passage 21 for the leads 17. Passage 21 communicates with a recess 22 in which the coupling portion 6 becomes lodged when the cartridge 15 is in the installed condition (FIG. 1). Prior to such installation, however, the recess 22 is spanned and closed by a plate 23 having a weakened zone 24 at which it is intended to break during the installation of the cartridge 15 in the pencil, i.e., when the cartridge is pushed onto the coupling portion 6.

In the embodiment of FIG. 4 the cartridge 15 is provided with a stepped part 25 onto which a tubular section 26 is pushed. The section 26 has a partition wall 28 formed with one or more slits 27 which constitute the weak zones at which the wall is to break. In this embodiment the funnel 20 (FIG. 2) of the cartridge is replaced with a funnel 30 that is provided on the coupling portion 29 of the propelling mechanism. The cap 19 in this embodiment is provided with a cleaning needle 31 (for cleaning the lead passage 4 shown in FIG. 1) which extends through the eraser when the cap 19 is in place. The eraser 18 may be provided with a hole or bore for this purpose.

FIG. 6 shows a modified embodiment of the member 23 of FIG. 2. In FIG. 6 this member is replaced by a ring 32 having having one or more inwardly projecting tongues 33 (one shown) of which one must extend across and beyond the center of the ring 32 so as to overlie and close the channel 21.

Another such modification is shown in FIG. 7 where a disk 40 is provided with a plurality of slits 41 which form, at the center of the disk 40, an annular space 42. One or more (one shown) webs 44 are integral with or secured (e.g., bonded) to the disk 40 and carry a small plate 43 which is located in the space 42 and closes the channel 21.

Either of the embodiments of FIGS. 6 and 7 can be used in FIG. 2 in lieu of the disk 23.

FIG. 8*a* shows a lead cartridge 35 which is composed of a minimum of individual parts. Its upper end is again closed by an eraser 18; in this embodiment a cleaning needle 38 is anchored in the eraser and can be used upon withdrawal of the eraser from the upper end of the cartridge 35. The lower portion of the cartridge 35 is bounded by a cylindrical wall 37 from which several ribs or webs 36, 36*a* extend lengthwise during a first step in the manufacture of the cartridge.

Figure 8B:
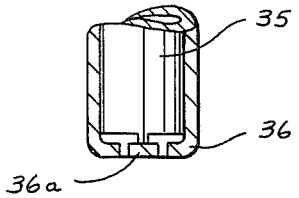
FIG. 8*b* shows the cartridge of FIG. 8*b* in a subsequent second manufacturing stage.
Figure 8C:
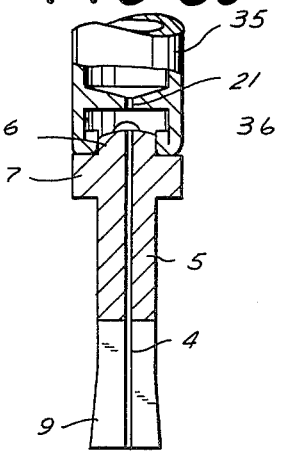
FIG. 8*c* shows the cartridge of FIG. 8*b* connected to a part of the lead propelling mechanism, i.e., in installed condition.

In a second subsequent manufacturing step, shown in FIG. 8*b*, these ribs or webs 36, 36*a* are bent over in inward direction—e.g., upon being subjected to heat, ultrasonic sound, or the like—so that at least one of them (here 36*a*) extends across the center of the cartridge and blocks the passage 21. When this cartridge is installed in the pencil (see FIG. 8*c* where the housing is omitted for clarity) these webs or ribs 36, 36*a* undergo a further deflection under the pressure of the portion 6, through about 90° in upward direction, so that the passage 21 is now open to the passage 4.

Figure 9:
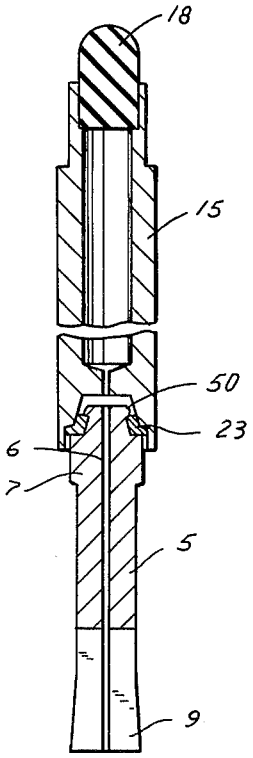
FIG. 9 is a longitudinal section showing a lead cartridge according to another embodiment, in installed condition.

Finally, FIG. 9 shows an embodiment in which the free end of the coupling portion 6 is provided with a bead 50 (may be circumferentially complete or interrupted) which, after bending over the portions 33 or 36, snaps in behind them (as shown). This snap-in effect can be felt and/or heard by the user and serves as a signal to indicate to the user that the cartridge 15 (or 35) is properly installed and that the pencil is ready for use.

The operation:

All of the embodiments herein operate in the same manner. The new (unopened) cartridge 15 or 35 is inserted from above into the barrel or housing 1 of the pencil and, by exertion of slight pressure, pushed onto the coupling portion 6 which breaks or dislodges the closure of the cartridge. During the procedure the portions 28, 33, 44, 36 become confined between the inner surface of the wall bonding the recess 22 and the outer surface of the portion 6, thus assuring that the cartridge is connected with the propelling mechanism in centered position and without any play. The pencil is now ready for use.

To effect feeding of a lead, the user then pushes the cap 19 (or in FIGS. 8*a* and 9 on the eraser 18) and thereby the cartridge which in turn moves the propelling mechanism 5 towards the pencil tip, counter to the force of spring 13 until the ring 11 abuts the shoulder 14. Further depressing subsequent to such abutment causes the head 9 to open (i.e., its jaws to move apart), and this permits the lead 17 in passage 4 to drop down to the brake 3. Another lead from the interior 16 is at this time already being guided into the passage 21 via the funnel 20. When the user now releases the cap 19 or the eraser 18, the spring 13 retracts the mechanism 5 until the ring 11 engages the ring 12 and causes the head 9 to close about the foremost lead 17. Renewed depressing of cap 19 or eraser 18 repeats the procedure, whereby the foremost lead 17 is advanced towards the tip of the pencil since the friction between lead 17 and head 9 is greater than the friction between the lead 17 and the brake 3. In this manner each lead is incrementally advanced to and forwardly beyond the tip of the pencil. When the lead portion which projects forwardly beyond the tip has been worn away during writing, the user again depresses and then releases the cap 19 or eraser 18, to propel another increment of the lead 17 out beyond the pencil tip. Since new leads 17 are constantly being fed into the passage 4 from the interior 16, the user may continue to repeat the advancing process until all of the leads in the cartridge are used up. The empty cartridge is then replaced with a new full one and writing can immediately resume.

A particular advantage of the invention resides in the fact that the use of the pencil—especially of a pencil using thin and very thin leads—is made much easier, since not everyone is able (e.g., because of lack of manipulative skills, shaking of a user's hands, and other problems) to transfer individual thin leads (having a diameter of about 0.3 mm) from a supply package into the pencil reservoir. Furthermore, all embodiments of the invention are very simple, therefore inexpensive and not prone to malfunctions. The invention can be readily incorporated in all known pushbutton-feed mechanical pencils, i.e., including those having a propelling mechanism different from the mechanism 5 shown herein which, incidentally, is known per se in the art. Removal of the empty cartridge is facilitated by having its upper end extend from the barrel 1 by a distance corresponding to at least the distance by which the mechanism 5 is advanced when cap 19 or eraser 18 are depressed.

While the invention has been illustrated and described as embodied in a mechanical pencil, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a mechanical pencil, a combination comprising a housing having a front end provided with a tip, and a rear end portion;

a lead-containing cartridge removably insertable into said rear end portion, and including a barrel having a leading end, an interior accommodating a plurality of leads, a lead outlet at said leading end and having one end, and coupling portions;

lead feeding means reciprocable in said housing for incrementally advancing leads from said rear end portion to and outwardly beyond said tip, and including an elongated casing having a first end portion provided with an annular collar having an upper end face directed away from said tip and adapted to support said leading end of said cartridge when the latter is installed on said housing and a lower end face directed towards said tip, said casing further having a throughgoing longitudinal passage operative for passing therethrough leads towards said tip;

resilient means urging said lead feeding means in direction away from said tip, and including a spring having one end supported by said lower end face of said collar and another end;

coupling means on said lead feeding means, engageable with said coupling portions, and operative for coupling with said lead containing cartridge so as to establish a lead supplying passage between the cartridge and said lead feeding means through which passage leads from the cartridge can sequentially pass to said lead feeding means, said coupling means including a part of said first portion of said casing extending beyond said upper end face and operative for engaging said coupling portions of said cartridge, and a recess having a circumferential shoulder, in said leading end of said barrel said recess being adapted to closely receive therein said part of said first end portion of the casing when said barrel is installed on said housing, said one end of said lead outlet of said barrel being so open into said recess that when said barrel is installed onto said housing said passage of the casing is coaxial with said lead outlet thereby establishing said lead supplying passage between the cartridge and the casing;

means for blocking said lead outlet until said coupling portions and said coupling means are in engagement with one another, and including a disc mounted in said recess so as to close the latter to thereby close the lead outlet of said barrel, said disc having at least one weakened portion, said disc being a ring and said weakened portion including at least one inwardly projecting tongue extending across and beyond the center of said ring so as to overlie and close the lead outlet, said ring being received in said circumferential shoulder of said recess, said ring having an outer diameter exceeding the inner diameter of said shoulder so that when said ring is rigidly installed onto said shoulder the ring takes a concave shape in said recess.

* * * * *